United States Patent [19]

Beyer

[11] Patent Number: 4,462,656

[45] Date of Patent: Jul. 31, 1984

[54] INSTALLATION SYSTEM OF LABELED CONDUCTORS INCLUDING PLUGS AND CONNECTING CENTERS

[75] Inventor: Dieter Beyer, Regensburg, Fed. Rep. of Germany

[73] Assignee: Siemens Aktiengesellschaft, Fed. Rep. of Germany

[21] Appl. No.: 321,266

[22] Filed: Nov. 13, 1981

[30] Foreign Application Priority Data

Nov. 24, 1980 [DE] Fed. Rep. of Germany ..... 3044131

[51] Int. Cl.[3] ..... H01R 13/50

[52] U.S. Cl. ..... 339/154 A; 339/91 R; 339/22 B; 339/113 R

[58] Field of Search ..... 339/32 R, 32 M, 33, 339/91 R, 113 R, 113 L, 184, 154, 155, 156, 21 R, 22 R, 22 B, 75 P, 159, 276

[56] References Cited

U.S. PATENT DOCUMENTS

| | | | |
|---|---|---|---|
| 2,714,712 | 8/1955 | Riccardelli | 339/159 C |
| 2,748,362 | 5/1956 | Andis | 339/75 P |
| 2,965,872 | 12/1960 | Linn | 339/159 R |
| 3,414,870 | 12/1968 | Biszko | 339/75 P |
| 3,426,216 | 2/1969 | Smith et al. | 339/154 R |
| 3,820,060 | 6/1974 | Smith | 339/276 R |

*Primary Examiner*—Eugene F. Desmond

*Attorney, Agent, or Firm*—Scully, Scott, Murphy & Presser

[57] ABSTRACT

An installation system of labeled conductors including plugs as well as connecting centers for permanent yet still flexible circuit connections, which also produce plug connections leading to a plurality of conductors. The system provides that (a) the connecting center includes contact rails directly connected to the leads of a conductor, which form a plurality of tongues for the socket contacts in socket plugs; (b) wherein the housing has the plug receivers receive the tongues in a recessed manner and forms protective collars fitted to the plugs; (c) and wherein at least one plug receiver is formed for connection to all contact rails.

20 Claims, 12 Drawing Figures

INSTALLATION SYSTEM OF LABELED CONDUCTORS INCLUDING PLUGS AND CONNECTING CENTERS

BACKGROUND OF THE INVENTION

1. Field of the Invention

The present invention relates to an installation system of labeled conductors including plugs as well as connecting centers for permanent yet still flexible circuit connections, hich also produce plug connections leading to a plurality of conductors.

2. Discussion of the Prior Art

An installation quick-coupling for such a system is known from German Published Patent Application No. 27 41 798. The known installation quick-coupling operates with a distributor onto which there can be plugged, for the supply thereof, input plugs with socket contacts. Provided in the current flow is an outlet plug box with plug contact sockets onto which there can be plugged a plug with plug contact pins of a coupling conductor. Junctions for energy supply are facilitated through outlet plug receivers on the back of the distributor for alternating current tap off and for multi-phase current tap off. The outlets are hereby so displaced so that there can be achieved a generally symmetrical loading.

The outlet plug receivers are provided with socket contacts and the associated outlet plugs with contact tongues. In order to ensure that voltage-conducting components will not be contacted, dependable codings are required.

Furthermore, plug contacts are currently being marketed which, for example, are utilized for the connection of illuminating members in built-in kitchens, which will prevent the contacting of voltage-conducting components wherein also the contact pins or the contact tongues are located protected within casings, whereby the associated socket contacts will engage between the pins or tongues and their casings. Such socket contact plugs can also be connected through a conductor as a ready-to-use coupling conductor with a tongue contact plug.

In order to provide for junctions, plug components can be introduced into the conductor train. (For example, as disclosed in German Published Patent Application No. 24 15 727 and German Laid-Open Patent Application No. 27 12 723). These and similar systems have in common that wiring labor will be saved at the building site. Such installation systems which, through the intermediary of plug components for switch functions will also enable electrical switching without wiring labor, occasion many transfer resistances. These resistances are particularly numerous when each plug box is attached on individually (German Laid-Open Patent Application No. 27 12 723).

These transfer resistances, on the one hand, increase the losses and heating and, on the other hand, compound sources of error.

When one follows the current path from one conductor through the plug components of the known type, there are obtained, for example, the following transfer or contact resistances: from the conductor to one connecting location in a plug, from the socket contacts to the contact pins or tongues, from the contact pins or tongues to the connecting contact of a distributor element in a plug component, eventually there is present ahead a branch-off connection, in essence, a connecting location in a distributor element, from the connection of the distributor element to a socket contact, from the socket contact to a contact pin or tongue, finally from the connection of the contact pin or the tongue to the conductor in the tap off. Thereby, the current path in one such single tap off evidences seven to eight transfer resistances. For conventional wiring in the usual wall inlet boxes, there is hereby present a single transfer or contact resistance in the connector terminal. The number of the transfer resistances increases still further in the plug systems with the number of the conductors being a factor.

SUMMARY OF THE INVENTION

Accordingly, it is an object of the present invention to develop an installation system which is suitable for permanent or steady operation, which is flexible while yet secure, and in which the number of transfer or contact resistances is drastically reduced.

The foregoing object is attained pursuant to the invention in that (a) the connecting center includes contact rails directly connected to the leads of a conductor, which form a plurality of tongues for the socket contacts in socket plugs; (b) wherein the housing has the plug receivers receive the tongues in a recessed manner and forms protective collars fitted to the plugs; (c) and wherein at least one plug receiver is formed for connection to all contact rails.

This installation system is flexible and secure since it can be plugged in; however, the tongues in the connecting center can be received in a recessed manner. It is essential that this installation system for a tap off suffices with merely three transfer resistances: from the conductor to the connecting location for the contact rails, from the tongues of the contact rail to the socket contacts of outlet plugs, and from the socket contacts to the connecting location of the branch conductor. The same is indicated in the current passage from connecting center to connecting center.

It is further essential that from the tongues of the connecting center leading to other branch conductors there will not be produced any additional transfer resistances.

It is advantageous that when the contact rails in a common housing are arranged so offset with respect their extent and the arrangement of plug receivers on the back of the housing, so in for a multi-phase system they are presently connected to other phase conductors. Hereby, there is produced a somewhat uniform loading. Furthermore, this renders it possible to utilize plugs of one type of construction for three-pole plugs.

The protective collars and the associated plugs through their configuration can provide an optical coding, and/or through means rendering them noninterchangeable, a mechanical coding. This will facilitate the easier manipulations thereof.

The leads of a conductor can be retained on the contact rails of the connecting center through a clamping retainer. For this purpose they can for example be crimped on. Hereby, the flanges of the rails or the rails themselves are bent and pressed about the conductors which are to be connected thereto. Such a connection is simple to produce and can be technologically completed by machine in a high-speed mode.

The housing of the connecting center can, in principle, be a parallelipiped structure which at one end face receives a connecting conductor to the other end of which there is fastened a plug, and which at an oppositely located end surface forms a plug receiver or receptacle for connection to all contact rails, and which is provided with latching elements. The latching facilitates a secure longterm operation. The latching can be so constructed that it can be released with either a tool or by hand.

The connecting center for a multi-phase system can facilitate tap-offs for alternating current as well as for three-phase alternating current when on the back of the housing there are formed besides the plug receivers for alternating current also such which are formed for three-phase alternating current plugs. The safety during longterm operation is afforded when the plugs which are associated which the plug receivers are provided with resilient flat-contact sockets.

The installation system can be modified for switching functions. In that connection, it is modified whereby at least one conductor with two leads is connected to discontinuous contact rail with presently one lead connected to one contact rail section, and wherein this section of the discontinuous contact rail and further contact rails terminate at their ends with plug receivers for connection to all contact rails. The conductor leading to a discontinuous contact rail hereby forms a switching conduit to the free end of which there can be connected a switch of the usual type. Overall there is thus formed an adaptor plug to whose switching conduit there can be connected a switch. Also this adaptor plug will produce relatively few transfer resistances. In addition thereto, the means for the tap-offs are not loaded by the requirements of the switch elements in their number of transfer resistances. The plug receivers for connection to all contact rails of the adaptor plug can be provided with latching elements.

The number of transfer or contact resistances of the adaptor plug is further reduced when only one plug receiver is constructed for connection to all contact rails and when a conductor is retained oppositely located, whose leads are held directly on the contact rails, in particular through a clamping retainer. Understandably, in lieu of contact rails there can also be utilized simple conductors.

A connecting center with an attached adaptor plug fulfills tap-off and switching functions. Through a corresponding switch conduit and interrupted locations of the contact rails in the adaptor plug, there can be effectuated the exchange, interchange, series and cross circuits which are known in the installation technology.

Arranged on the housing of the connecting center can be retaining elbow with means for quick-fastening in order to be able to rapidly fasten the installation system on support rails or other carrying means. Such support rails can be carrying frames located in ceiling interspaces or in other hollow spaces. The retaining elbow can, advantageously be formed of essentially a U-shape, of which one arm is connected with the housing and in which there are formed threaded apertures, and wherein the other arm is traversed by a wing screw which fits into one of the threaded apertures.

Also known are installation systems with switching functions which can be plugged in and which operate with auxiliary conductors having voltages applied thereto for effectuating switching (German Published Patent Application No. 24 15 727, German Laid-Open Patent Application No. 27 12 723). When in such a known system there is actuated the control switch contact of a control key module then a current flows across this contact from the supply current conductor to the switch conduit and through an excitation coil of a relay of a switch module and from there through the supply conduit. By means of this current there can be excited a relay, which closes a contact whereby a supply current conductor is now connected through from the input to the output of the switch module. As a result, thereof, the system output of the switch module conducts current and the electrical apparatuses connected to the output there of are then actuated (German Published Patent Application No. 24 15 727). The inventive installation system is adequate without additional conductors and is substantially simpler.

BRIEF DESCRIPTION OF THE DRAWINGS

Reference may now be had to the following detailed descriptions of exemplary embodiments of the invention, taken in conjunction with the accompanying drawings; in which.

DETAILED DESCRIPTION

Figure 1:
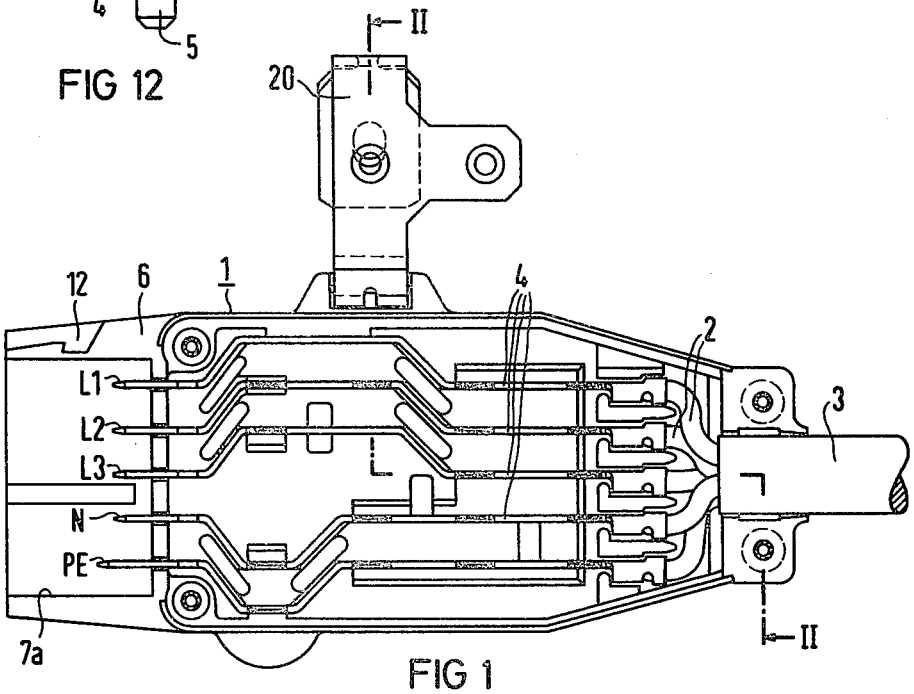
FIG. 1 illustrates a connecting center with two housing shells in a plan view, in which one housing shell has been removed.

The connecting center 1 according to FIG. 1 includes leads 2 of a conductor 3 which are directly connected to contact rails 4. Three contact rails can represent the phase conductors L1, L2 and L3, and two contact rails 4 represent the zero conductor N and, with reference, the protective conductor PE. The contact rails 4 respectively form a plurality of tongues 5 pursuant to FIG. 2, which can be coupled with socket contacts in socket plugs. The housing of the connecting center 1 consists, in the embodiment pursuant to FIG. 1, of two housing shells 6. The housing receives the tongues 5 in the plug receiver 7 in a recessed arrangement. It forms protective collars 8 which are fitted to the plugs. At least one plug receiver 7*a* pursuant to FIG. 1 is formed as a connection to all contact rails.

Accessible in the plug receivers 7 is presently only one phase for alternating current connection and three phases for three-phase current connection. It is also possible to so form a three-phase connection so that there can be selectively plugged in an alternating-current plug or a three-phase alternating current plug. Hereby, there are merely to be provided both codings in the plug box.

Figure 12:
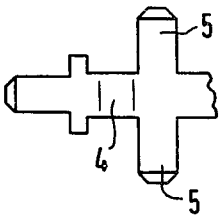
FIG. 12 illustrates, in a partly broken open manner, a contact rail for the connecting center pursuant to FIG. 1.

The contact rails 4 are arranged so offset in a common housing 6, 6, with respect to their extension and the arrangement of the plug receivers 7 on the back of the housing, that for a multi-phase system they are presently connected to other phase conductors. Thereby the loading will be distributed. A suitable construction of the contact rails 4 with respect to an offset arrangement of plug receivers 7 can be ascertained from a combined overview of FIGS. 1 and 3 providing an exemplary embodiment. In FIG. 12 there is illustrated, in a broken through representation, a contact rail 4 with respectively oppositely located formed tongues 5.

The protective collars 8 can, through their configuration or color selection, form an optical coding. In the exemplary embodiment, through means for ensuring noninterchangeability 10, grooves in the plug receiver and complementary fitted projections in the plug, there is formed a mechanical coding.

The leads 2 of the conductor 3 in the exemplary embodiment pursuant to FIG. 1, are directly connected to the contact rails 4 through a clamping retainer. Hereby, flanges or the rails themselves are bent about an pressed against the conductors, to be connected which is designated as crimping.

Figure 4:
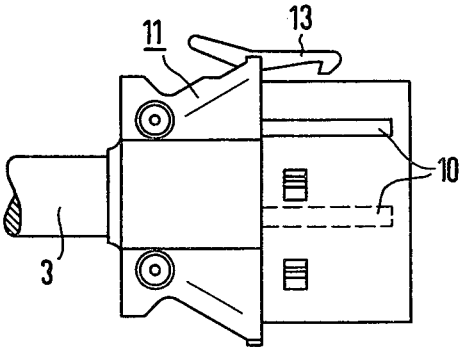
FIG. 4 illustrates a connecting plug which is to be considered fixedly connected with the connecting center pursuant to FIG. 1 through a conductor.

The housing of the connecting center 1 pursuant to FIG. 1 is essentially a parallelipiped structure combined of two housing shells 6 formed of insulating material. In the illustrated embodiment, attached to one end surface is a connecting conductor 3 to the other end of which there is fastened a plug 11 as a connecting plug, pursuant to FIG. 4. Formed at the opposite end surface of the connecting center 1 is a plug receiver 7*a* for connection to all contact rails. The plug receiver 7*a* is provided with latching elements 12 into which there can engage the latching levers 13 of plugs pursuant to FIG. 4.

Figure 3:
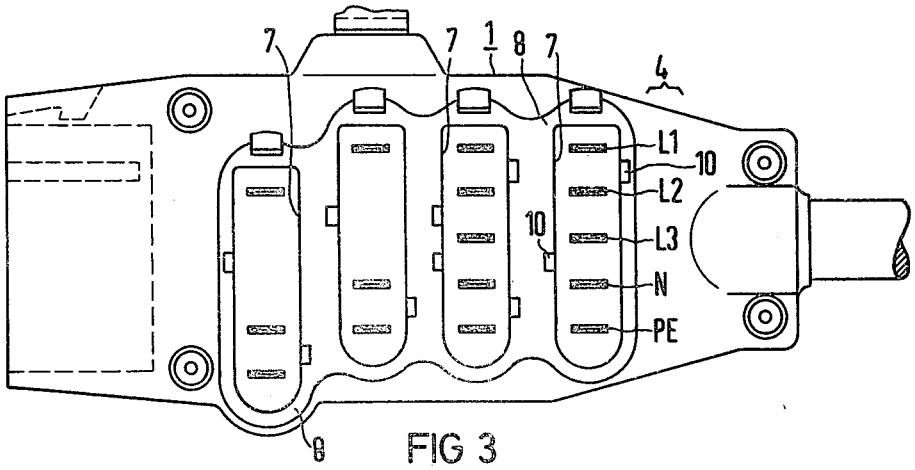
FIG. 3 illustrates a plan view of the connecting center according to FIG. 1 with assembled housing shell.
Figure 5:
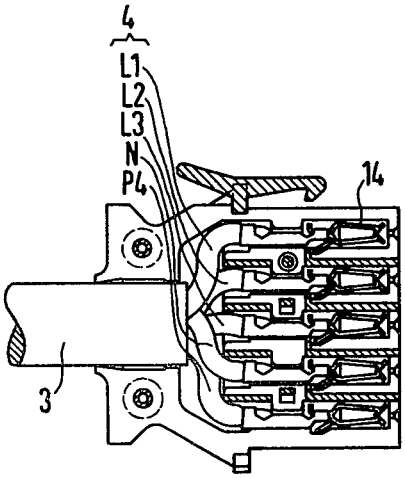
FIG. 5 illustrates the connecting plug pursuant to FIG. 4 in an opened condition.
Figure 7:
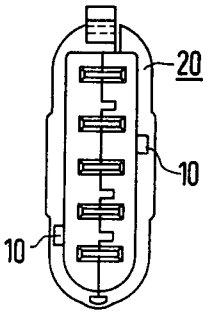
FIG. 7 illustrates the plug according to FIG. 6 from an end surface thereof.

On the back of the housing of the connecting center according to FIG. 3, besides plug receivers for alternating current plugs having a total of three contact elements, there are also formed such for three-phases alternating current plugs with a total of five contact elements. The plugs which are associated with the plug receivers 7 and 7*a* can be advantageously provided with a resilient flat-contact sockets 14, as illustrated from the plug 11 formed as a connecting plug pursuant to FIG. 4, and represented by the plugs pursuant to FIGS. 5, 6 and 7, as well as 8 and 9. Such flat-contact sockets 14 can be slid onto the tongues 5 of the contact rails 4.

The installation system with the connecting center 1 fulfills a distributor function since on the back of the housing, in the plug receiver 7 there are adapted to be inserted plugs as outlet plugs. Further connecting centers can be plugged onto the plug receiver 7*a* for connection to all contact rails 4 with their connecting plugs according to FIG. 4.

Figure 6:
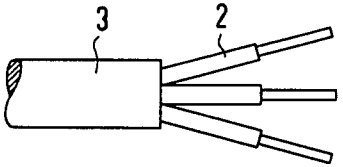
FIG. 6 illustrates a three-pole plug with connecting conductor, shown partly broken open.
Figure 6:
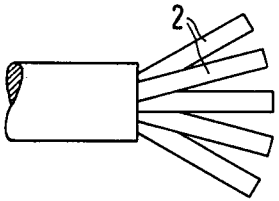
Figure 6:
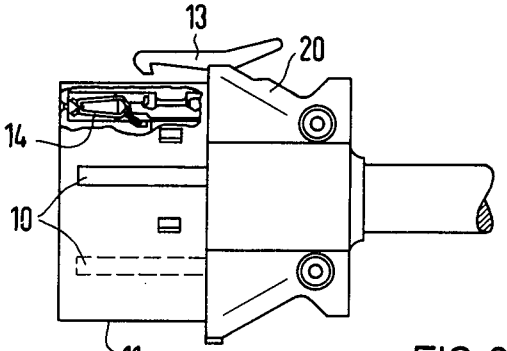

The plug with connecting conductor pursuant to FIG. 6 and the end view pursuant to 7 is constructed as a three-pole outlet plug which, in a single housing 20, takes up only three flat-contact sockets 14 namely one for the phase L1 and respectively one further contact each for zero conductor N and the protective contact PE. Such a plug pursuant to FIG. 6 can be plugged in at the back of the connecting center 1 pursuant to FIG. 3. The correct connection is ensured through the means 10 for noninterchangeability, in essence, protection on the plug housing and associated grooves in the plug receiver on the back from the connecting center 1. The embodiment of the plug pursuant to FIG. 6 evidences a lever 13 for latched retention on the plug receiver pursuant to FIG. 3.

Figure 9:
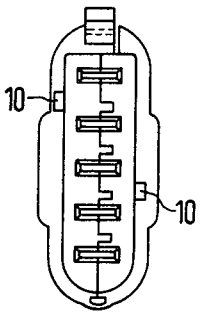
FIG. 9 illustrates the connecting plug pursuant to FIG. 8 shown from the end surface thereof.
Figure 8:
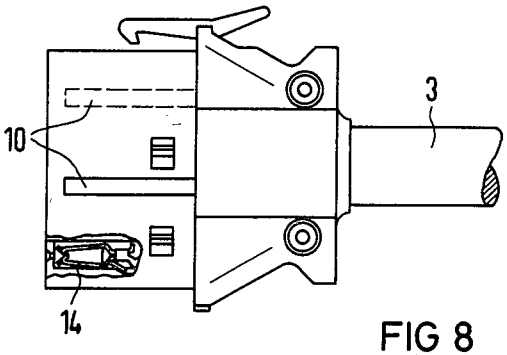
FIG. 8 illustrates a five-pole plug as represented in FIG. 6 which evidences another mechanical coding.

The plug according to FIGS. 8 and 9 is formed as a five-pole plug for plugging into plug receptacles on the back of the distributor center 1 according to FIG. 3. It distinguishes externally from the plug according to FIGS. 6 and 7 only through the otherwise arranged means 10 for noninterchangeability for the coding. For the remainder there are inserted in the plug respectively five flat-contact sockets 14. The conductor 3 correspondingly takes up five leads 2, wheras the conductor 3 of the plug pursuant to FIGS. 6 and 7 contains only three leads 2.

The installation system facilitates the formulation of network-type branches for the distribution of energy. The five-pole further conduction to other distribution centers is effected through the plug receiver 7*a* for connection to all contact rails.

The installation system is suited for the plugging in of switch connections when a special plug is utilized which here is called an adaptor plug. At least one conductor with two leads is hereby connected to a discontinuous contact rail of the adaptor plug with respectively one lead to one contact rail section. This conductor is the switch conductor which can be conducted to a switch. The sections of the discontinuous contact rails and other contact rails terminate at their ends into plug receivers for connection to all contact rails. Such an adaptor plug is illustrated in the embodiment according to FIG. 10.

A conductor 33 with two leads 2 is connected to a discontinuous contact rail with respectively one lead connected to one contact rail section. These sections of the discontinuous contact rail and other contact rails, which are shown in the drawing as being covered, terminate at their ends in a plug receiver 7*a* or a plug 7*b* for connection to all contact rails.

Figure 10:
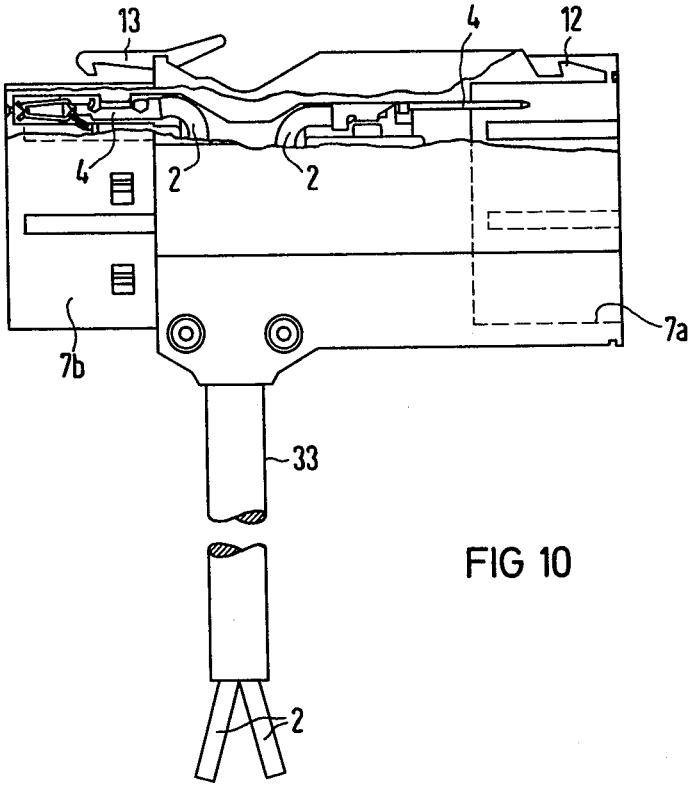
FIG. 10 illustrates an adaptor plug with switch conductor, shown partly broken open, and for a shortened switch conductor.

The adaptor plug according to FIG. 10 facilitates the plugging in of a switch function, in essence, according to the embodiment the switching on and switching off. For this purpose there need be connected to the conductor 33 merely an installation switch of the usual type which is constructed as an on/off switch. Latching means 12 and 13 facilitate the adaptor plug to be connected to the connecting center 1 according to FIG. 1 with the plug side 7*b* so as not to be lost. The appliance which is to be switched on can be connected through a corresponding plug into the plug receiver 7*a*. The adaptor plug can be plugged directly into the distributor center or through a connecting conductor. It can include its own retaining means as is described for the connecting center.

Figure 11:
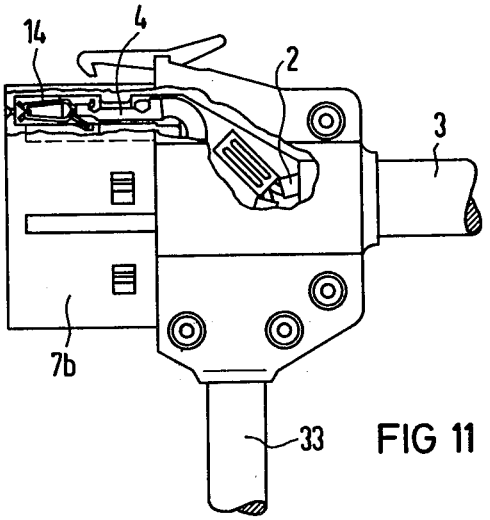
FIG. 11 illustrates a plug in the manner of function of the adaptor plug pursuant to FIG. 10 which, however, evidences only one plug side, wherein an outlet conductor is connected at the other side which leads to an appliance to be switched therefrom.

The number of the transfer resistances of the adaptor plug pursuant to FIG. 10 is further reduced when only one plug receiver or one plug is constructed for connection to all contact rails, as is illustrated in FIG. 11. Eliminated thereby are the trasfer resistances between the adapter plug and the outlet plug. The plug 7*b* can again receive flat-contact sockets 14 for connection to all contact rails 4. Oppositely located there is introduced a conductor 33 whose leads 2 are directly retained on the contact rails 4 through a clamping fastening.

The adaptor plug pursuant to FIG. 10 and the combination plug according to FIG. 11 can, in lieu of rails 4, also simply contain conductors of electrically-conductive material. These plug elements can, for the remainder, in a known manner be so constructed that changeover or crossing switches can be connected to the conductor serving as the switch conductor 33.

Figure 2:
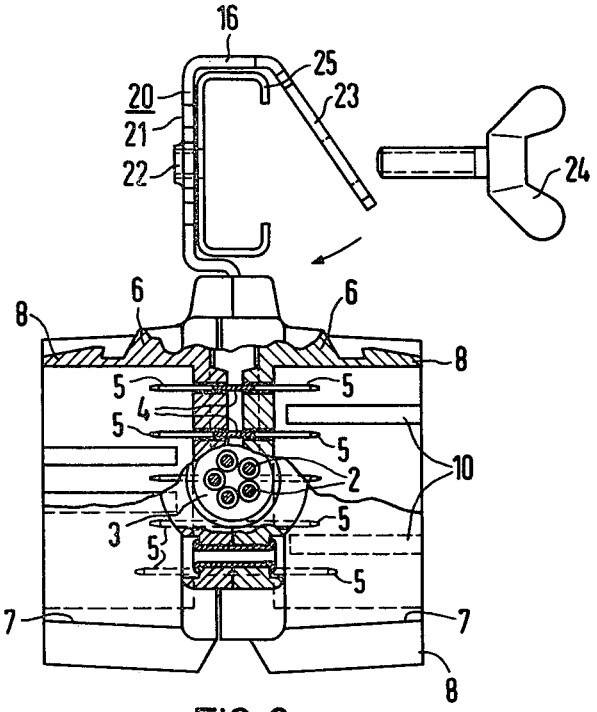
FIG. 2 illustrates a sectional view through the connecting center of FIG. 1, taken along line II—II, and which is illustrated for a closed connecting center.

The installation system can be especially easily assembled, for example suspended in ceiling spaces, when there is arranged on the housing of the connecting center 1 a retaining elbow 20 according to FIGS. 1 and 2 with a quick-fastening. This quick-fastening is achieved in the exemplary embodiment in that the retaining elbow 20 is essentially U-shaped, whose one arm 21 is connected with the housing and in which there are formed threaded apertures 22. Its other arm 23 is traversed by a wing screw 24 which fits into one of the threaded apertures 22. In FIG. 2 the assembly is illustrated in the type of an exploded representation. In the retaining elbow 20 there can be received, for example, a hollow rail with a C-profile 25 as a support rail, as is illustrated in FIG. 2.

What is claimed is:

1. In a multiphase distribution system of labeled conductors including plugs and connecting centers for flexible and permanent switch connections which form plug connections to a plurality of conductors the improvement comprising: said connecting center including a plurality of contact rails permanently connected to the leads of a flexible conductor for multiphase distribution; said contact rails forming a plurality of tongues for plug contacts in branch socket plugs; a housing having a plurality of single phase branch plug receivers for receiving the branch tongues in a recessed arrangement and forming protective collars adapted to be fitted to said branch plugs; at least one multiphase branch plug receiver for receiving a three phase alternating current plug and at least one main plug receiver being formed for connection to all of said contact rails.

2. A distribution system as claimed in claim 1, said protective collars having a configuration adapted to provide an optical coding.

3. A distribution system as claimed in claim 1, said protective collars having a configuration adapted to include mechanical means to render predefined plug and collar combinations noninterchangeable.

4. A distribution system as claimed in claim 1, wherein the conductors are directly crimped by said contact rails.

5. A distribution system as claimed in claim 1, wherein said system further includes branch plugs adapted to be inserted into said branch plug receivers, said branch plugs having resilient flat-contact sockets.

6. In a distribution system of labeled conductors including plugs and connecting centers for flexible and permanent switch connections which form plug connections to a plurality of conductors, the improvement comprising; said connecting center including a plurality of contact rails permanently connected to a plurality of leads from a flexible conductor; said contact rails forming a plurality of tongues for engaging plug contacts mounted in one or more branch socket plugs; a housing having branch plug receivers for receiving the branch tongues in a recessed arrangment and forming protective collars adapted to be fitted to said branch plugs, said branch plugs adapted to be inserted into said branch plug receivers, said branch plugs having resilient flat-contact sockets; and at least one main plug receiver being formed for connection to all of said contact rails.

7. A distribution system as claimed in claim 6, wherein the branch plug receiver for three phase alternating current plugs is arranged on a back of said housing.

8. A distribution system as claimed in claim 1 or 6, wherein said contact rails are arranged in said housing in an offset manner with respect to one another to provide an arrangement of branch plug receivers on a back of the housing that receive branch plugs for a multiphase system and provide, via the same contact rails on a front of the housing, branch plug receivers for other phase conductor plugs.

9. A distribution system as claimed in claim 1 or 6, said housing of the connecting center being essentially a parallel-piped structure with first and second ends; a main conductor cable located on the first end of the housing, said main cable having a main plug fastened to the other end thereof; said housing defining a main plug receiver on the second end for continuous connection of all contact rails, said housing including a latching means.

10. A distribution system as claimed in claim 1 or 6, which further comprises an adaptor plug having at least one switch conductor with two leads that may be connected on either side of a discontinuous contact rail with two sections, one of said discontinuous contact rail sections and other contact rails terminating at their ends in a main plug receiver, and a main plug for a continuous connection to all contact rails.

11. A distribution system as claimed in claim 10, which furthter comprises a latching means between all of said plug receivers and said plugs for connection to all of said contact rails.

12. A distribution system as claimed in claim 10, which further comprises a single main plug adapted for connection to all contact rails at a further connecting center; and a second main conductor being located between said main plug and said adaptor plug, said second conductor having leads permanently fastened to the contact rails through clamping fasteners.

13. A distribution system for installing multiple branch plug connections to a plurality of conductors:

(a) a multiconductor multiphase main cable having a plurality of conductors therein, each of said conductors terminating in a first end;

(b) a connecting center for receiving the first end of the conductors in said main cable, said center having:

(i) a plurality of contact rails permanently secured to said first ends of said conductors;

(ii) each of said contact rails defining a plurality of tongues, said tongues from one or more rails defining branch plug contacts for predefined rails and conductors;

(c) a housing surrounding said center said housing having first and second side, said housing defining a plurality of branch plug receivers, each of said receivers extending outwardly beyond each set of branch plug contacts to form a protective collar therefor; said housing also defining on the second side thereof, a branch plug receiver for three phase alternating current;

(d) a plurality of single phase branch plugs adapted to connect a plurality of branch cables to three or more rails in said center;

(e) at least one main plug receiver with main plug contacts being formed to provide a continuing connection for all contact rails and main cable conductors.

14. A distribution system as claimed in claim 13, wherein the branch plug receivers defined by the housing are female, and the branch plug contacts mounted therein are male.

15. A distribution system as claimed in claim 13, said housing of the connecting center being essentially a parallel-piped with first and second ends, a main conductor cable located on the first end of the housing, said cable having a main plug fastened to the other end thereof; said housing defining a main plug receiver on the second end for continuous connection of all contact rails.

16. A distribution system as claimed in claim 13 wherein said system further includes branch plugs adapted to be inserted into said branch plug receivers, said branch plugs having resilient flat contact sockets.

17. A distribution system as claimed in claim 13 wherein said contact rails are arranged in said housing in an offset manner with respect to one another to provide an arrangement of branch plug receivers on a back of the housing that receive branch plugs for a multiphase system, and provide, via the same contact rails on the front of the housing, branch plug receivers for other phase conductor plugs.

18. A distribution system as claimed in claim 17, said protective collars having a configuration adapted to include mechanical means to render predefined plug and collar combinations noninterchangeable.

19. A distribution system as claimed in claim 13 which further comprises an adaptor plug having at least one switch conductor with two leads that may be connected into a discontinuous contact rail with said discontinuous contact rail sections and other contact rails terminating at their ends in a main plug receiver and a main plug for a continuous connection between all contact rails.

20. A distribution system as claimed in claim 19 which further comprises a single main plug adapted for connection to all contact rails at a further connecting center; and a second main conductor being located between said main plug and said adaptor plug, said second conductor having leads permanently fastened to the contact rails through clamping fasteners.

* * * * *